United States Patent [19]

Nobes et al.

[11] 4,167,835

[45] Sep. 18, 1979

[54] DEMOUNTABLE SASH LOCK

[75] Inventors: W. Douglas Nobes; Peter G. Matroniano, both of Rochester, N.Y.

[73] Assignee: Caldwell Manufacturing Company, Rochester, N.Y.

[21] Appl. No.: 379,040

[22] Filed: Jul. 13, 1973

[51] Int. Cl.[2] ..... E05D 13/04

[52] U.S. Cl. ..... 49/449; 49/453

[58] Field of Search ..... 49/449, 450, 451, 453

[56] References Cited

U.S. PATENT DOCUMENTS

| | | | |
|---|---|---|---|
| 2,818,610 | 1/1958 | Pengelly | 49/451 |
| 3,099,050 | 7/1963 | Hetman | 49/450 X |
| 3,122,797 | 3/1964 | Segre | 49/453 X |
| 3,129,470 | 4/1964 | Schneider | 49/450 |
| 3,156,294 | 11/1964 | Miller et al. | 160/281 X |
| 3,455,060 | 7/1969 | Fournier | 49/450 X |
| 3,482,354 | 12/1969 | Trout | 49/453 X |
| 3,810,332 | 5/1974 | Grossman | 49/450 |

*Primary Examiner*—Philip C. Kannan

*Attorney, Agent, or Firm*—John P. Murphy

[57] ABSTRACT

A window construction for pivot-out sash wherein a demountable sash guiding lock is mounted on the top rail of said sash. The lock includes a spring actuated plastic latch having either left or right hand openings for receiving a finger button which is demountable from said sash and a retaining clip for maintaining the spring for actuating the latch within the top rail of the sash.

2 Claims, 3 Drawing Figures

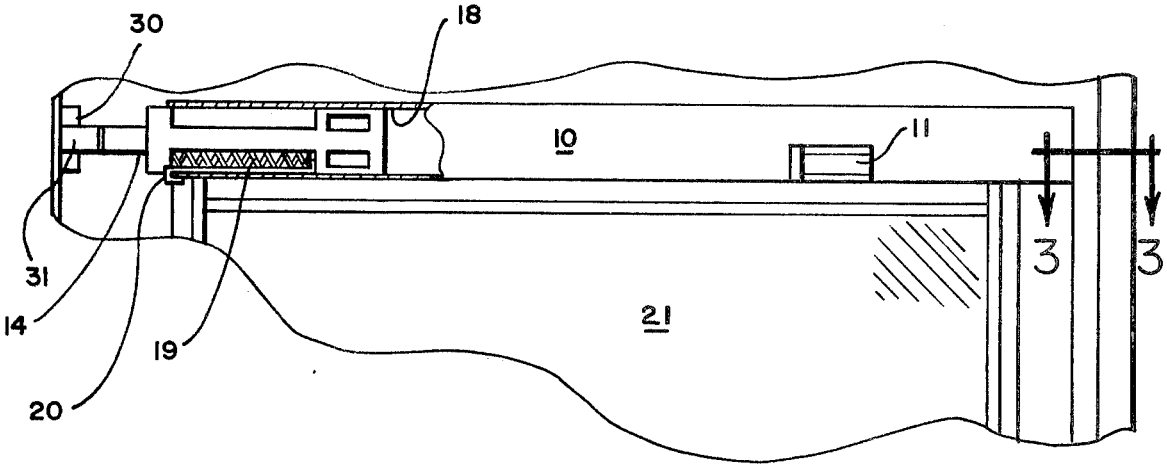
FIG. 1
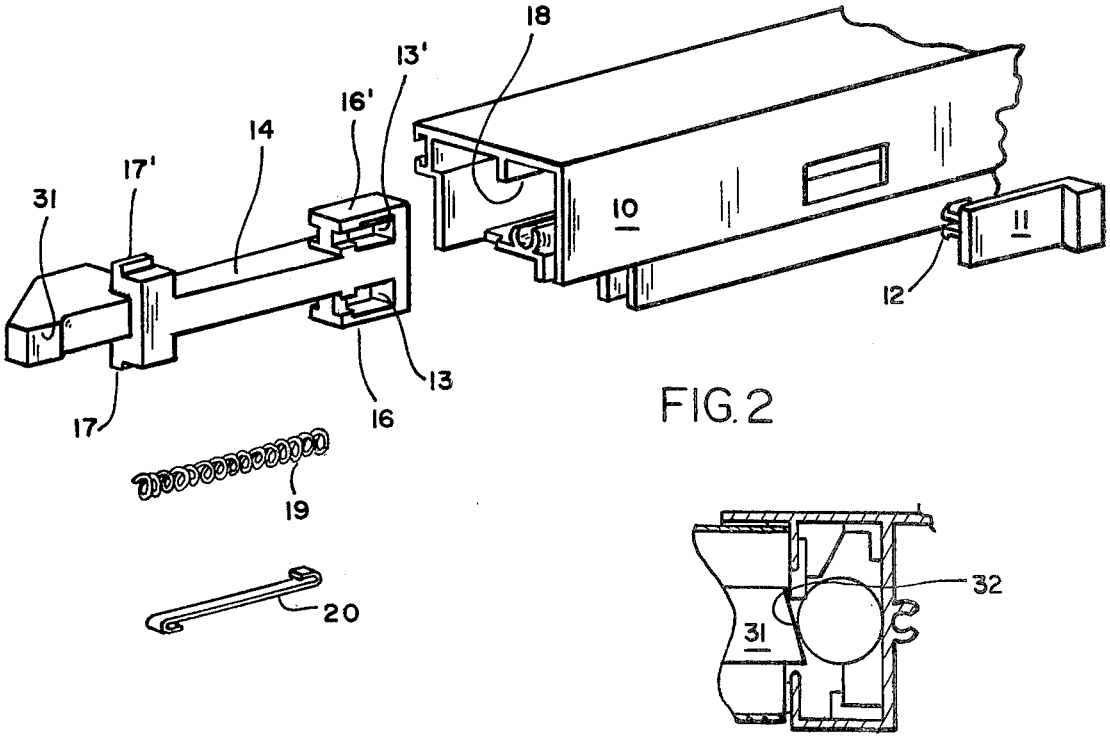
FIG. 2
FIG. 3

DEMOUNTABLE SASH LOCK

BACKGROUND OF THE INVENTION

Heretofore, many latching mechanisms have been provided for window sashes. However, a particular problem arises in the construction of the pivotable, take-out type of window where the upper part of the sash must be secured in the slide channels in a weather-tight manner.

There has also been a problem in manufacturing where left and right hand latches had to be produced from a different mold, particularly in the case of slidable plastic latches.

SUMMARY OF THE INVENTION

The present invention provides a demountable latching mechanism for pivoted take-out windows wherein the latch bolt may be mass-produced and can be easily fitted into either the left or right hand side of the upper rail of the pivoted sash.

BRIEF DESCRIPTION OF THE DRAWINGS

FIG. 1 shows the upper rail of a slidable pivoted window sash with a sash guiding lock mounted thereon, with parts broken away;

FIG. 2 is an exploded view, of the sash guiding lock and shows the slide latch with the two alternative openings into which an operating clip button may be fastened, which is located on the outside of the sash rail, and which enables the latch to be used in either the right or the left hand side for receiving the plastic finger button;

FIG. 3 is a sectional view taken along lines 3—3 of FIG. 1.

DESCRIPTION OF THE PREFERRED EMBODIMENT

Referring to the drawings, it will be noted that in FIG. 1, there is shown a top rail 10 of a pivotable sash having an opening therein for inserting a finger button 11 which has flexible retaining clips 12 for insertion in rectangular opening 13 of slide latch 14 in a demountable condition. Openings 13 and 13' are provided so that either may be used depending upon whether the latch is mounted on the left or right side of the sash. Latch 14 has slide surfaces 16, 16' and 17, 17' for movement in and out of channel 18 of the top rail of the pivoted sash, and is preferably made of nylon.

In the operation position of the sash, the guiding lock with the slide latch is in a locked position and retained there by spring 19, held in place in channel 18 by clip 20 which is maintained in position when the finger button is pushed so as to move latch 14 and slide member 31 out of engagement with the side channels of window 21. Thus, there is provided a window having a frame which incorporates side jambs and a sash for disposition between said jambs, said sash having slide components with a lateral margin of a slide latch confronting said jambs, slide member 31 carried in the lateral margins of the sash being moveable therewith during travel of the latter relative to the jambs, a guide member 30 fixed on each jamb and the slide member 31, slidably engaging the confronting guide member 30. The slidable latching means 14, with slide member 31, are provided adjacent the upper sides of the top rail 10, while latching means 14, and slide member 31, are moveable between a first position wherein the upper portion of the sash is locked to the guide member 30, and a second position wherein the upper portion of the related slide member 31 is moved from engagement with said guide member 30.

When the sash is moved back into the operating position, there is a camming surface which moves the slide member 31 into the second position, and automatically moves the slide member 31 into the second position past the channel guide member 30, and then the spring 19 moves the slide member 31 into the locked engagement of the first position for the normal operation of the sash. Means are also provided for pivotally engaging the ends of said slide members to the marginal portions of the guide member and when the latching means are in the second position, the sash may be swung with relation to the guide member on the side jamb, and conventional resilient counter-balancing or sash balancing mechanism 32 are operably connected with the jamb and with the sash for counter-balancing the sash.

It should be understood that changes and modifications in the formation, construction, and arrangement and combination of the several parts of the tilt-in window sash may be made and substituted for these herein shown and described, without departing from the nature and principle of the invention.

We claim:

1. For use with a window having a frame incorporating side jambs with guide members, the improvement comprising a sash for disposition between said jambs and having a sash guiding lock mounted on the top rail of said sash including a slide latch with a slide member confronting said guide members on said jambs, said slide member being moveable with said sash during travel of the latter relative to the jambs, said sash guiding lock with said slide latch and slide member being moveable between a first position wherein said slide member is locked into operating engagement with said guide members, and a second position wherein the said slide member is moved from engagement with said guide member whereby said sash may be pivoted out of engagement with said jambs, said sash guiding lock having a spring actuated slide latch including a spring with retaining means for holding said spring in the operating position, and means pivotally engaging the lower ends of said sash whereby when said slide member is in the said second position said sash may be swung with relation to said guide member and counterbalancing means operatively connecting said jamb to said sash.

2. For use with a window having a frame incorporating side jambs, the improvement comprising a sash for disposition between said jambs and having latching means with lateral margins confronting said jambs, said latching means including a slide latch member carried on the top lateral margins of said sash, and being moveable therewith during travel of the latter relative to the jambs, a guide member fixed on each jamb, each slide latch member slideably engaging the confronting guide member, said latching means provided adjacent the upper side ends of the sash being moveable between a first position wherein said slide latch member is engaged with said guide member, and a second position wherein the said slide latch member is moved from engagement with said guide member, whereby said sash may be pivoted out of engagement with said jambs, said latching means including a demountable sash guiding lock mounted on the top rail of said sash including a spring actuated plastic latch, and a retaining clip attached to said spring and to said sash for maintaining said spring in the operating position within the top rail of said sash, means pivotally engaging the lower ends of said sash whereby when said latching means are in said second position said sash may be swung with relation to said guide members, and counter-balancing means operatively connecting said jamb and said sash.

* * * * *